United States Patent [19]

Fang

[11] Patent Number: 4,736,973

[45] Date of Patent: Apr. 12, 1988

[54] TUBULAR DOOR LOCK WITH A DEAD BOLT ADJUSTABLE IN TWO SIZES WITHOUT ANTI-BURGLARY DEVICE

[75] Inventor: Yau C. Fang, Chiayi, Taiwan

[73] Assignee: Posse Lock Manufacturing Co., Ltd., Chiayi, Taiwan

[21] Appl. No.: 933,144

[22] Filed: Nov. 21, 1986

[51] Int. Cl.[4] ..... E05C 1/16

[52] U.S. Cl. ..... 292/337; 292/DIG. 60

[58] Field of Search ..... 292/337, DIG. 44, 169.13, 292/169.15, 169.14, 1, DIG. 60

[56] References Cited

U.S. PATENT DOCUMENTS

| | | | |
|---|---|---|---|
| 4,372,594 | 2/1983 | Gater | 292/DIG. 44 X |
| 4,602,490 | 7/1986 | Glass et al. | 292/337 X |
| 4,662,665 | 5/1987 | Lin | 292/337 X |

*Primary Examiner*—Richard E. Moore

*Attorney, Agent, or Firm*—Holman & Stern

[57] ABSTRACT

This invention concerns a tubular door lock with a dead bolt adjustable in two sizes without anti-burglary device. It contains an extending shell covering outside of the basic shell and able to move inward or outward so as to alter the length of the dead bolt to the bottom of the extending shell into two sizes—so-called 60 mm and 70 mm—for fixing on a door.

2 Claims, 3 Drawing Sheets

TUBULAR DOOR LOCK WITH A DEAD BOLT ADJUSTABLE IN TWO SIZES WITHOUT ANTI-BURGLARY DEVICE

BACKGROUND OF THE INVENTION

This inventor has an earlier patent application for called "A cylinder door lock with a dead bolt adjustable in two sizes" Ser. No. 6-865,135. The previous invention concerns a door lock with an anti-burglary device, and this one concerns a similar lock except that it does not have an anti-burglary device and is used at a door for a bathroom, a child's room, or corridor etc., which does not particularly need such a device.

SUMMARY OF THE INVENTION

This invention makes use of an extending shell mounted outside around a basic shell and a fixing pin to selectively lock in either of two fixing holes on the extending shell so as to alter the distance between the dead bolt and the bottom plate of the extending shell. When the extending shell is adjusted to the long distance, it will simultaneously pull an extending linking plate to make a hook of the extending linking plate able to move along its slot. And when an activating plate is pulled, the linking plate and the extending linking plate can be simultaneously pulled up or first the extending linking plate and then the linking plate is pulled so that the dead bolt is also pulled, too.

DETAILED DESCRIPTION OF THE INVENTION

Figure 1:
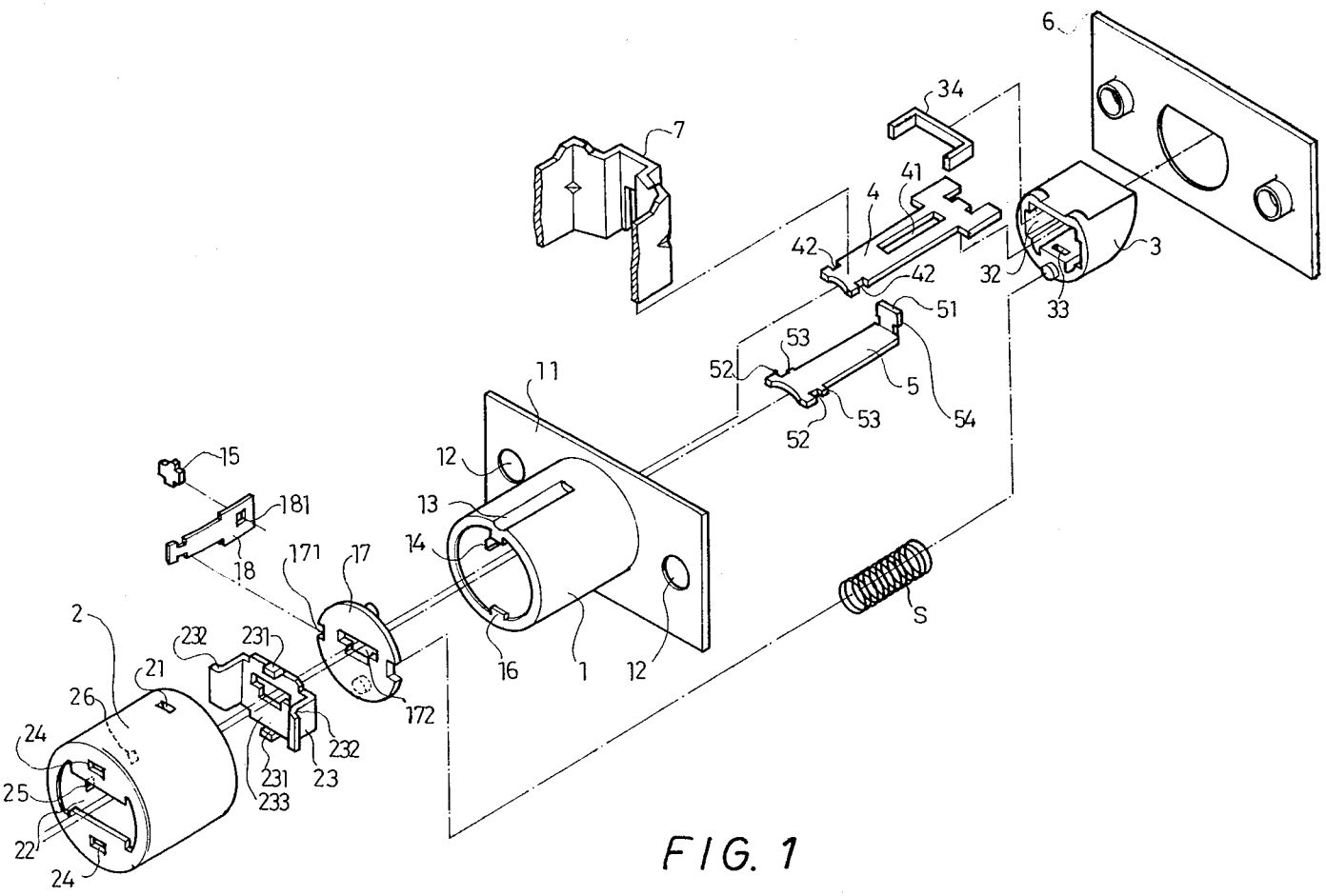
FIG. 1 is an exploded perspective view of a lock according to this invention.

The illustrated lock comprises basic shell 1, extending shell 2, dead bolt 3, linking plate 4, extending linking plate 5 and fixing plate 6.

Basic shell 1 includes a fixing plate 11 which is bored with two fixing holes 12 for bolting basic shell 1 on the side surface of a door, and a cylinder which is set with straight slot 13 for extending shell 2 to move along it by means of its inward projection 21. In addition, at one side of basic shell 1 there is a fixing hole 14 for a fixing pin to insert. And at the end side of basic shell 1—fixing plate 11 is defined as the beginning side and the cylinder the end side—is set two locking projections 16 for restricting stopping plate 17 and preventing it from falling off.

Extending shell 2 is formed as a cylinder with a bottom plate. The bottom plate has aperture 22 for linking plate 4 and extending linking plate 5 to extend out.

By means of an inward projection 21 at extending shell 2, extending shell 2 can move along straight slot 13 of basic shell 1. Assembled at the interior bottom of extending shell 2 is activating plate 23 which has two connecting projections 231, which can lock in and be pressed together with fixing holes 24 at the bottom plate of extending shell 2, and two activating hooks 232, which are to connect with activating plate 7 of the knob so as to maintain basic shell 1 positioned in its place and pull linking plate 4 and extending linking plate 5. In addition, bored at the side of extending shell 2 are two fixing holes 25, 26, either of which can face against fixing hole 14 for fixing pin 15 to insert in.

Dead bolt 3, functioning the same as the known art, makes use of slot 32 for linking plate 4 to run in and locking aperture 33 for locking with a projection at the bottom of linking plate 4 and U-shaped plate 34 to fix linking plate 4 and round projection 35 for locating one end of a spring S.

Linking plate 4 possesses a projection not shown, for locking in locking aperture 33 of dead bolt 3 and is fixed by U-shaped plate 34. Straight slot 41 can be locked with hook 51 of extending linking plate 5 and allows extending linking plate 5 move along it. In addition, a pair of hooks 42 is to connect with an activating plate 7.

Extending linking plate 5 is set with a hook that can lock in slot 41 of linking plate 4 and makes use of two projections 54 to prevent it from loosening off linking plate 4. And when the pair of hooks 52 faces against the pair of hooks 42, they can be connected together with activating plate 7.

As for stopping plate 17, it has another notch 171 which can be locked by plate spring 18 that is bored with fixing hole 181 for fixing pin 15 to insert. Usually, fixing pin 15 is pushed by plate spring 18 to extend out of fixing hole 14 of basic shell 1 and lock in fixing hole 25 or 26 of extending shell 2. That is, by means of extending shell 2 pushing pin 15 inward, pin 15 can lock in hole 25 or 26 by moving extending shell 2 to locate the extending shell in a required position.

Stopping plate 17 and activating plate 23 have respectively T-shaped aperture 172, 233 whose wide-bored part is for linking plate 4 to extend out and the narrow-bored part is to restrict extending linking plate 5. At two sides of extending linking plate 5, there is respectively locking projection 53 that is to lock at the outward side of activating plate 23 so as to keep hooks 52 of extending linking plate 5 extend out at the outside of the activating plate 7. The purpose of the above mentioned design is that when extending shell 2 is contracted, hooks 42, 52 all extend out at the outside of extending shell 2, as shown in FIG. 2, and when extending shell is extended, extending linking plate 5 will be automatically brought out as shown in FIG. 4 to keep hooks 52 at the outside so as to be hooked by activating plate 7.

Figure 2:
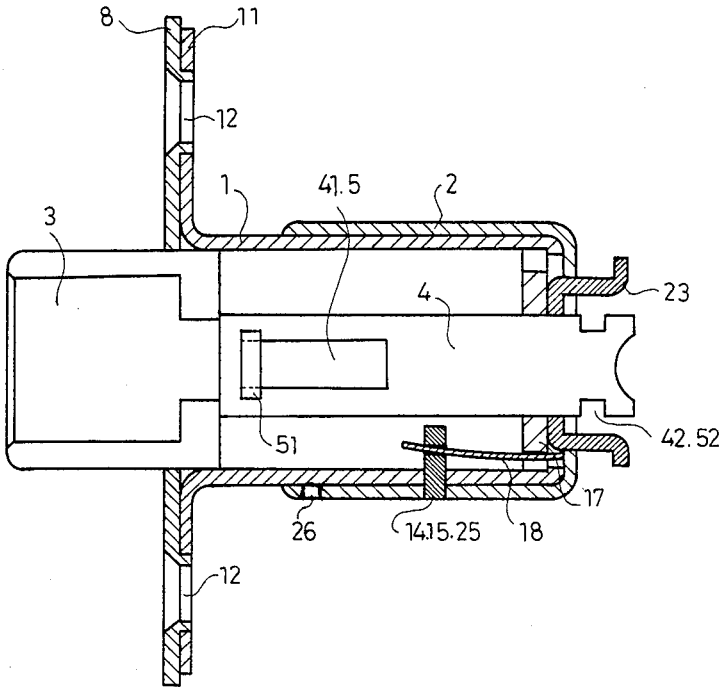
FIG. 2 is a cross-sectioned view of the lock in contracted condition.
Figure 3:
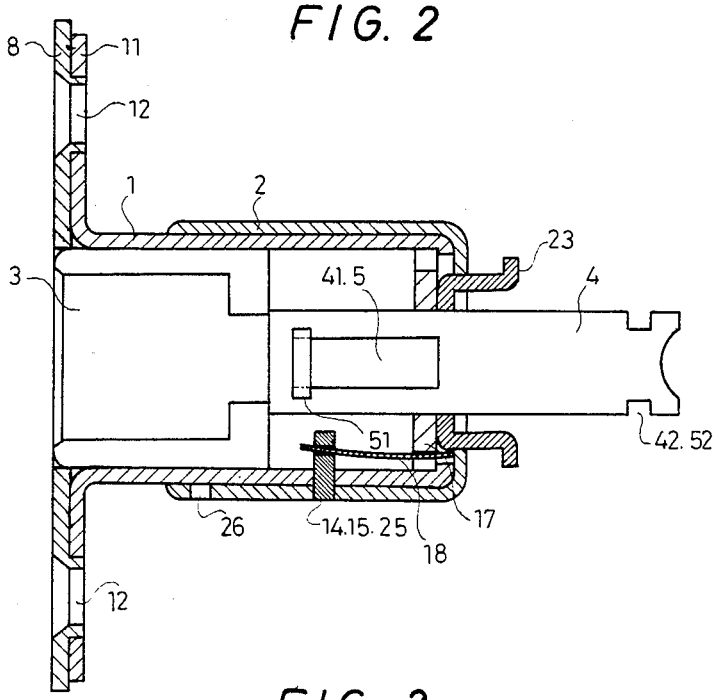
FIG. 3 is a view similar to FIG. 2 with the dead bolt retracted.

FIG. 2, a cross-sectioned view of the present assembled invention, shows that hooks 51 of extending linking plate 5 are located at the end of slot 41 and hooks 42, 52 match with each other and extend out at the same time at the outside of extending shell 2, therefore, activating plate 7 can lock them up at the same time, so that when activating plate 7 is pulled up dead bolt 3 may be pulled inwards, as shown in FIG. 3.

Figure 4:
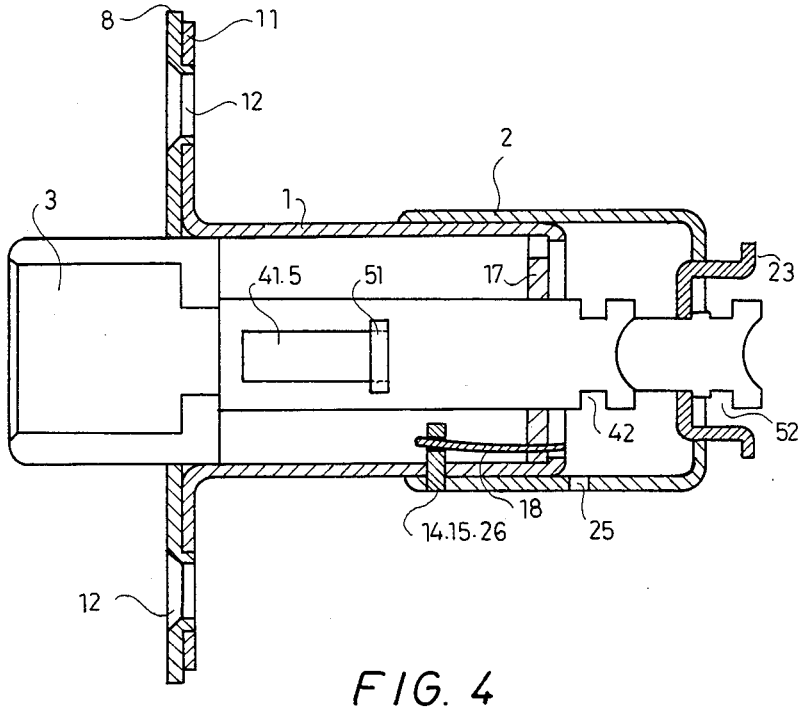
FIG. 4 is a view similar to FIG. 2 in the extended condition of the lock.
Figure 5:
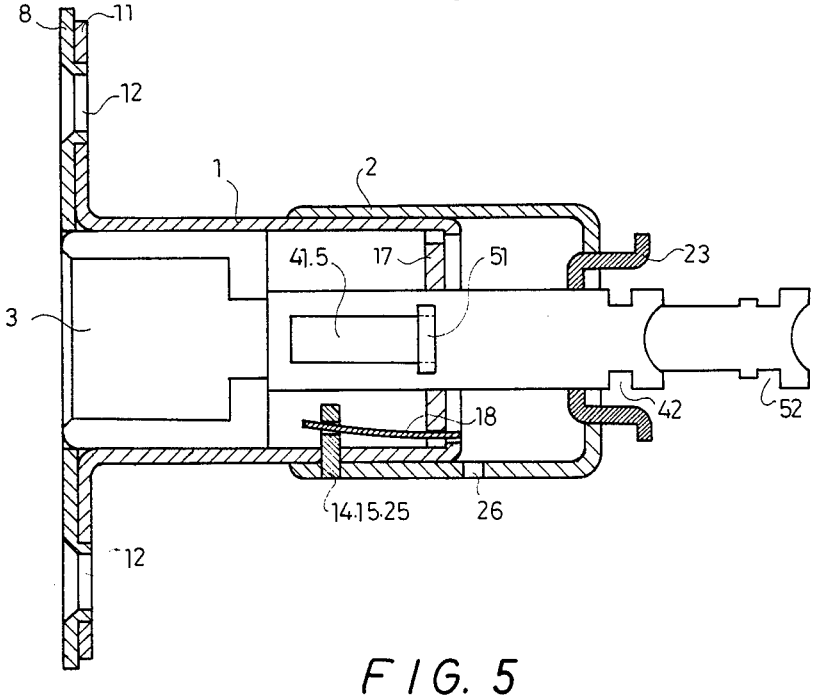
FIG. 5 is a view similar to FIG. 4 with the dead bolt retracted.

Furthermore, as shown in FIG. 4, when fixing pin 15 is moved to make extending shell 2 extended and lock in hole 26, extending linking plate 5 will be simultaneously pulled outward and hooks are still maintained at the outside of extending shell 2 so that extending linking plate 5 can move along slot 41 from one end to the other via its hook 51, and can further pull linking plate 4 and dead bolt 3 by the restriction of hook 51 and slot 41, as shown in FIG. 5, if it is pulled by activating plate 7.

What is claimed is:

1. A tubular door lock adjustable for length between a contracted condition and an extended condition comprising a basic shell which includes a cylinder and a fixing plate; said cylinder having a straight slot for guiding an extending shell and a locking projection in a back wall of the cylinder, a stopping plate in the cylinder against said projection, and a first fixing hole in a circumferential wall of the cylinder; an extending shell on the cylinder having a rear wall with an aperture, two further fixing holes in the rear wall, a stationary activating plate in the extending shell with two activating hooks projecting through the further fixing holes and being exposed at the outside of the extending shell, and two additional fixing holes in a circumferential wall of the extending shell for selective alignment with said first fixing hole; a bolt in the cylinder which is provided with a slot, a linking plate received in the slot, and a U-shaped plate fixing the linking plate in the slot, said linking plate including a projection at one end for locking in said slot of the bolt, a straight slot in the linking plate for receiving a hook of an extending linking plate, and a pair of hooks at the other end of the linking plate for engagement with a movable door knob activating plate; an extending linking plate having a hook for engaging in said slot of the linking plate, and a pair of further hooks at one end for engaging said movable activating plate, and pair of projections behind said pair of hooks to location outside of said stationary activating plate so as to retain said pair of hooks outside of the stationary activating plate; a spring pin within the cylinder projecting through said first fixing hole for selective engagement in said additional fixing holes, whereby compression of the fixing pin allows the extending shell to be moved for selective location of the fixing pin in said additional fixing holes to adjust the lock as between the contracted and extended conditions, wherein in the contracted condition both said hooks of the extending linking plate and the linking plate extend at the outside of the extending shell for engagement by the movable door knob activating plate and in the extended condition of the lock, the hooks of the linking plate are contained within the extending shell and only the hooks of the extending linking plate are extended outside of the extending shell for engagement by a movable door knob activating plate.

2. A tubular door lock as claimed in claim 1 wherein said hook of the extending linking plate has an enlarged head preventing the extending linking plate from being separated from the linking plate.

* * * * *